US006061967A

United States Patent [19]

Judds

[11] Patent Number: 6,061,967

[45] Date of Patent: May 16, 2000

[54] OVERHEAD DOOR SEALING ASSEMBLY

[76] Inventor: Raymond E. Judds, 3835 N. 68th St., Lincoln, Nebr. 68507

[21] Appl. No.: 09/233,697

[22] Filed: Jan. 19, 1999

[51] Int. Cl.[7] ..... E06B 1/70

[52] U.S. Cl. ..... 49/469; 49/304

[58] Field of Search ..... 49/469, 470, 27, 49/483.1, 467, 368, 304, 475.1; 160/40

[56] References Cited

U.S. PATENT DOCUMENTS

| | | | |
|---|---|---|---|
| 1,683,793 | 9/1928 | Nyman | 49/483.1 |
| 2,663,057 | 12/1953 | Uphoff | 49/470 X |
| 2,686,943 | 8/1954 | Kunkel | 49/470 X |
| 2,933,784 | 4/1960 | Hooverson | 49/483.1 |
| 3,566,541 | 3/1971 | Coulter | 49/467 |
| 3,851,420 | 12/1974 | Tibbetts . | |
| 4,055,917 | 11/1977 | Coller . | |
| 4,126,966 | 11/1978 | Lobell . | |
| 4,509,999 | 4/1985 | Sandor . | |
| 4,565,033 | 1/1986 | Tinfow | 49/468 |
| 4,745,716 | 5/1988 | Kuypers . | |
| 4,911,964 | 3/1990 | Corbo et al. . | |
| 5,010,691 | 4/1991 | Takahashi . | |
| 5,129,194 | 7/1992 | Grimsdale . | |
| 5,179,804 | 1/1993 | Young . | |
| 5,199,369 | 4/1993 | Meyer . | |
| 5,384,982 | 1/1995 | Galperin | 49/27 |
| 5,475,946 | 12/1995 | Howe . | |
| 5,481,076 | 1/1996 | Mullet et al. | 49/27 X |
| 5,581,946 | 12/1996 | Lin | 49/483.1 X |

*Primary Examiner*—Daniel P. Stodola
*Assistant Examiner*—Hugh B. Thompson
*Attorney, Agent, or Firm*—Jeffrey L. Thompson; Thompson & Thompson, P.A.

[57] ABSTRACT

A door sealing assembly for closing the gap between the lower edge of a door and an underlying floor surface includes an elongated threshold mounted to the floor beneath an overhead door. The threshold presents a plurality of slots which can be aligned with and coupled to fasteners anchored to the floor surface itself. The lower surface of the threshold further includes an adhesive layer which further contributes to the secure mounting of the threshold to the floor as well as inhibiting draught between the floor and threshold. The upper surface of the threshold presents a recess extending along the length thereof. A seal is attached to the lower edge of the door and is configured to nest within the recess. A resilient sheet of impervious material extends across the recess when the door is in an open position and is depressed into the recess by the seal when the door is moved to a closed position to close the gap between the lower edge of the door and the underlying floor surface.

20 Claims, 8 Drawing Sheets

OVERHEAD DOOR SEALING ASSEMBLY

BACKGROUND OF THE INVENTION

This invention relates to devices for restricting the passage of air and moisture through a gap between the floor and door and, more particularly, to an improved door sealing assembly for restricting the passage of elements between the bottom of an overhead door and the floor.

Several devices and methods are known in the art for restricting draught and weather from penetrating the gap between a door and the floor as described in U.S. Pat. No. 5,475,946. Although assumably effective for their intended purpose, such devices and methods are unsatisfactory to entirely restrict weather elements from being driven beneath an overhead door.

Water is often driven beneath overhead doors, such as garage or other industrial doors, during a severe weather event because the strong winds can displace the bottom of the door from a sealed position. More particularly, known thresholds are either inadequately secured to a floor surface or do not fully capture a door therein. Further, known devices do not adequately seal the gap between the lower edge of the door and the floor surface.

Therefore, it is desirable to have an overhead door sealing assembly which restricts inward and outward movement of the door when the door is closed. It is further desirable to have an overhead door sealing assembly which provides an improved water seal between the lower edge of a door and the floor.

SUMMARY OF THE INVENTION

Accordingly, I have invented an overhead door sealing assembly having an elongated threshold which can be securely mounted to the floor beneath an overhead door in two ways. First, the lower surface of the threshold presents a plurality of slots which can be aligned with a plurality of fasteners fixedly mounted within the floor surface itself, e.g. anchor bolts. The slots are configured such that the threshold can then be snappably coupled to the fasteners. Second, the lower surface of the threshold includes a layer of an adhesive which both enhances the secure mounting of the threshold as well as inhibiting draught between the floor and the threshold.

The upper surface of the threshold presents a recess which extends along the length of the upper surface and is aligned with the path of the overhead door. A seal is attached to the underside of the door and is configured to nest tightly within the recess when the door is moved to a closed position. A resilient sheet of impervious material is attached to the upper surface of the threshold and extends across the recess when the door is in an open position. The resilient sheet is depressed into the recess by the seal upon movement of the door to a closed position to thereby close the gap between the lower edge of the door and the floor surface. While many different configurations are suitable, the seal and recess must have corresponding configurations for nesting. When in the closed position, the door is captured within the recess and prevented from moving inwardly or outwardly.

It is therefore a general object of this invention to provide an overhead door sealing assembly which restricts the passage of weather elements beneath an overhead door.

Another object of this invention is to provide a sealing assembly, as aforesaid, which can restrict movement of an overhead door that is in a closed position.

Still another object of this invention is to provide a sealing assembly, as aforesaid, having a threshold configured to nest with a seal attached to the lower edge of the overhead door.

Yet another object of this invention is to provide a sealing assembly, as aforesaid, which can form a weather barrier between the seal and the threshold.

A further object of this invention is to provide a sealing assembly, as aforesaid, in which the threshold can be anchored to a floor surface to restrict movement of an overhead door.

A still further object of this invention is to provide a sealing assembly, as aforesaid, which forms a seal between a floor surface and the threshold itself to prevent draught thereunder.

Another object of this invention is to provide a sealing assembly, as aforesaid, which can repel a rising level of standing or flowing water.

Other objects and advantages of this invention will become apparent from the following description taken in connection with the accompanying drawings, wherein is set forth by way of illustration and example, embodiments of this invention.

DESCRIPTION OF THE PREFERRED EMBODIMENT

Figure 1:
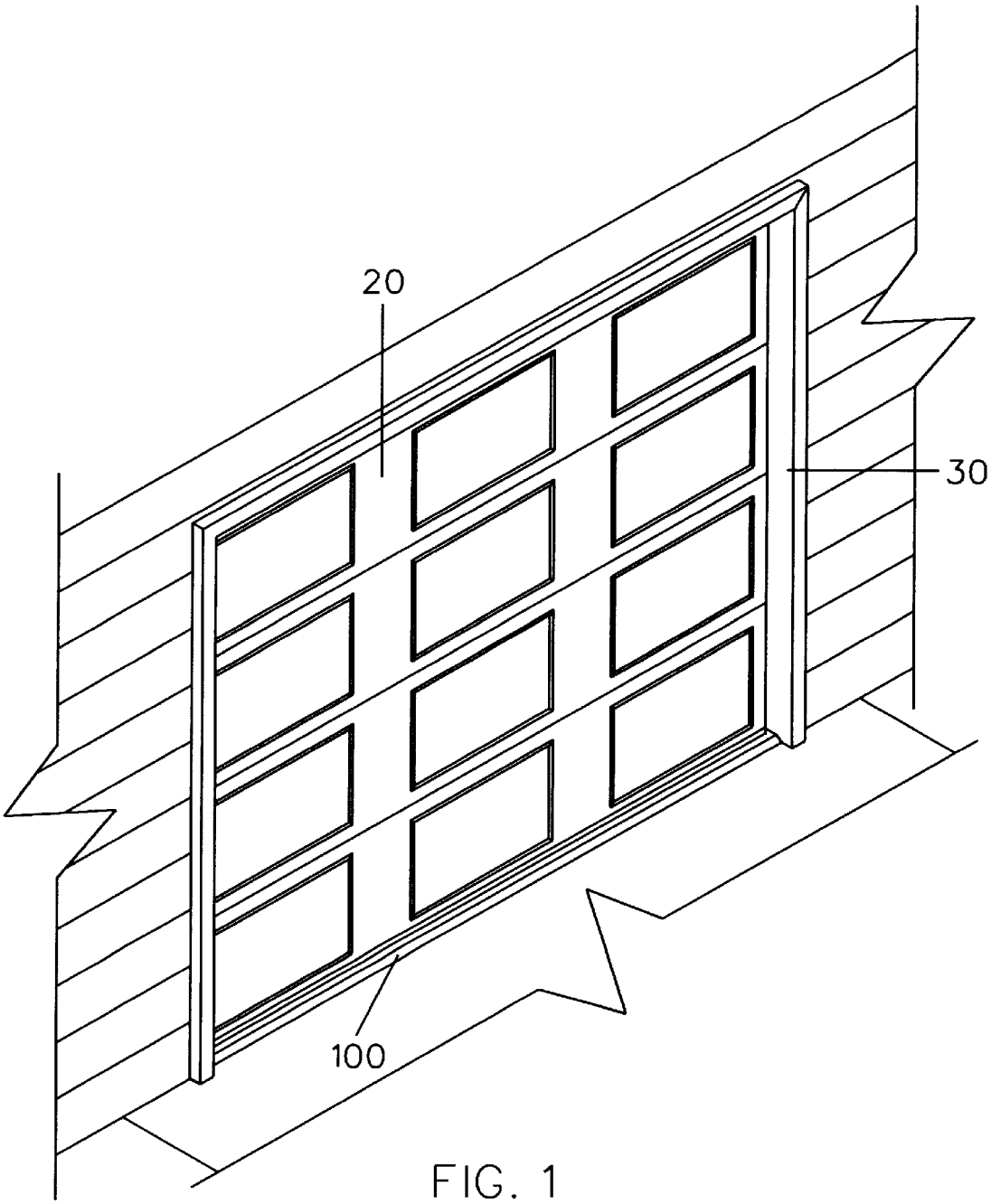
FIG. 1 is a perspective view of the overhead door sealing assembly according to the present invention with the overhead door in a closed position.
Figure 2:
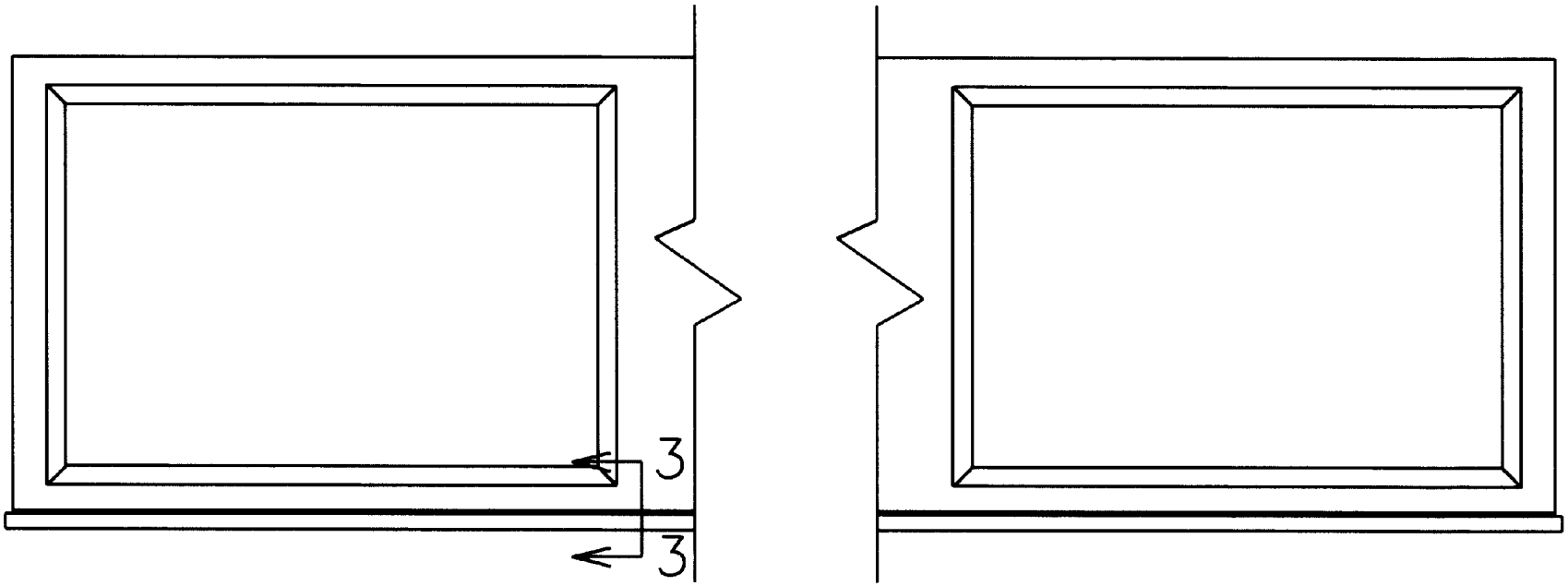
FIG. 2 is a broken view of the lower panels of the overhead door in a closed position.
Figure 3:
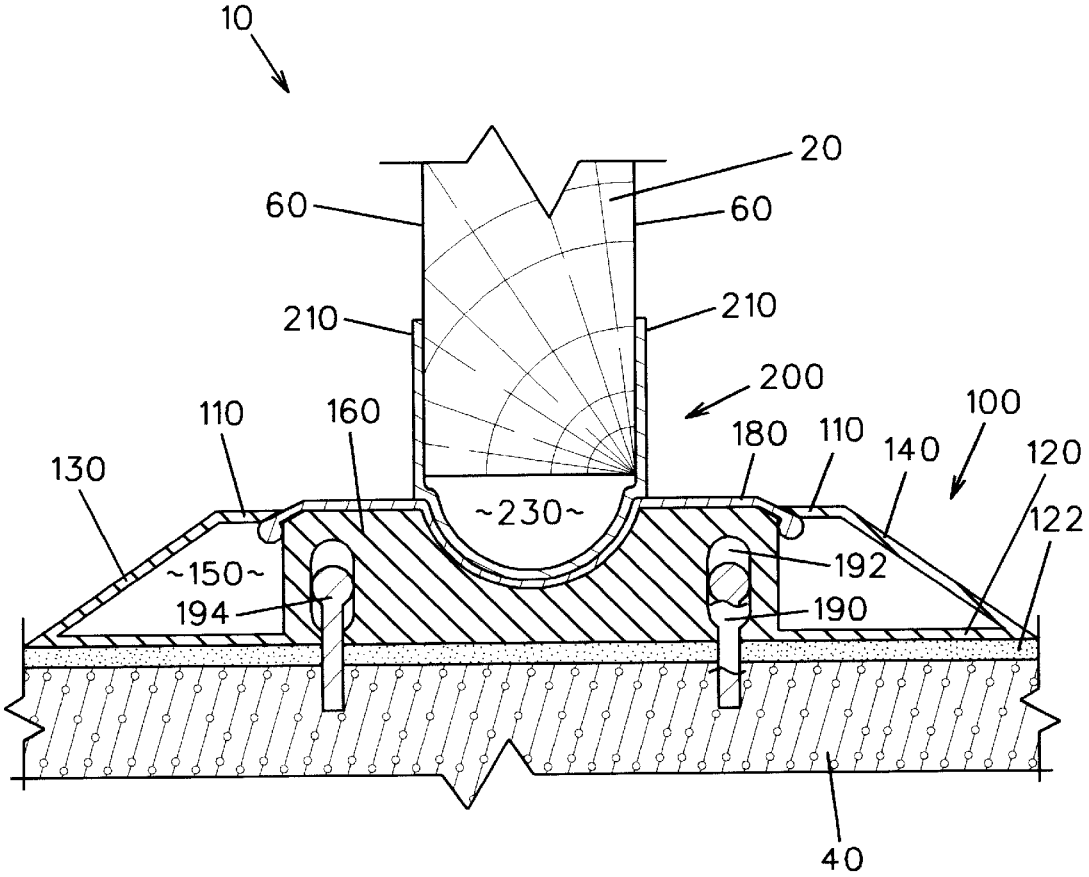
FIG. 3 is an enlarged sectional view of the overhead door assembly taken along line 3—3 of FIG. 2 with the door seal nesting within the threshold recess.
Figure 4:
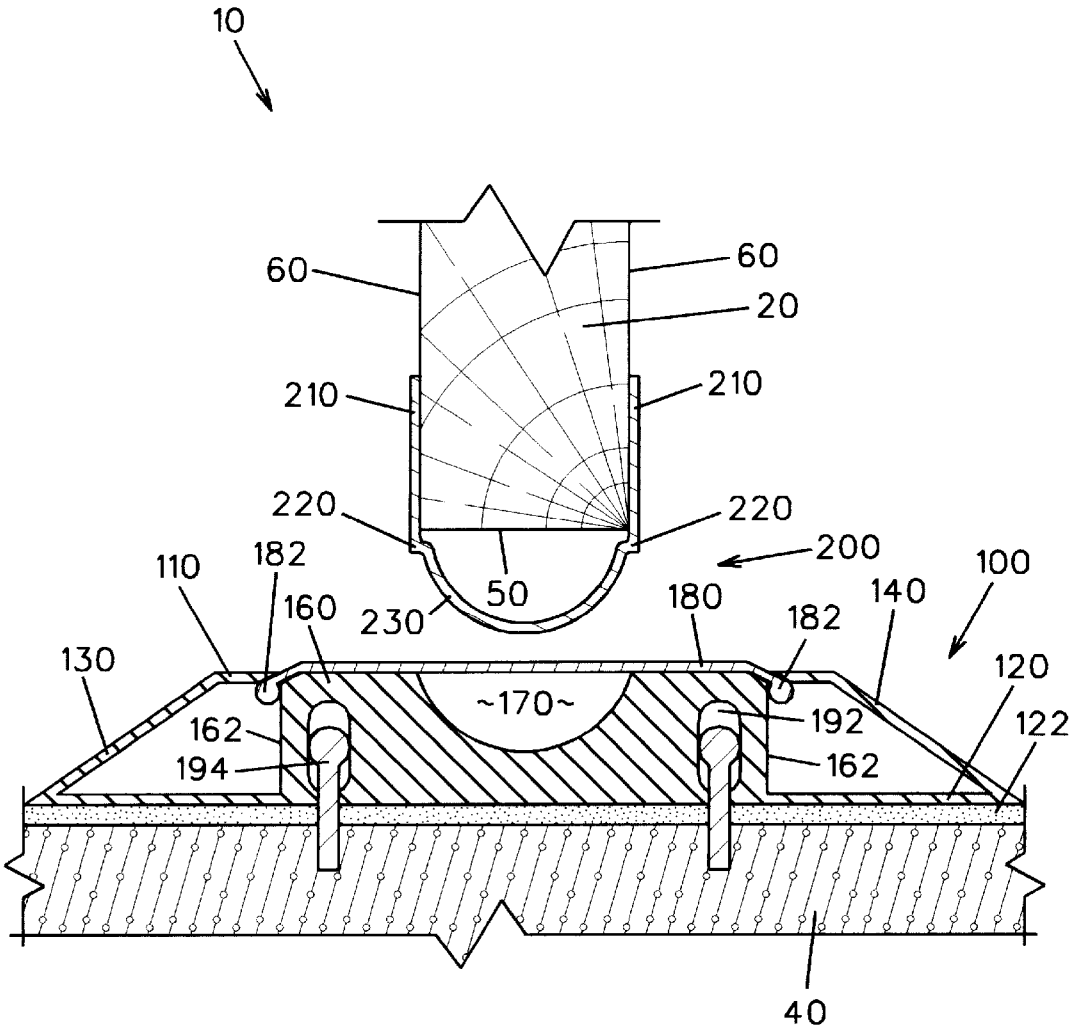
FIG. 4 is a view as in FIG. 3 with the seal displaced from the threshold recess.

Turning more particularly to the drawings, FIGS. 1 through 4 show the overhead door sealing assembly 10 according to the now preferred embodiment of the present invention. The assembly 10 is adapted for use with an overhead door 20, such as a garage door or other industrial style door, which is mounted to move vertically between open and closed positions. In a closed position, the door 20 nests within an elongated threshold 100 as more particularly described below (FIGS. 3 and 4).

The elongated threshold 100 is preferably constructed using a recycled material such as extruded aluminum although other suitable materials may be used. The threshold 100 is generally trapezoidal having parallel upper 110 and lower 120 surfaces with oppositely disposed inwardly inclined interior 130 and exterior 140 side walls extending therebetween. Thus, the walls 110, 120, 130, 140 of the threshold form an interior cavity 150.

The threshold 100 further includes a body portion 160 integrally attached to upper 110 and lower 120 walls and extends therebetween. The body portion 160 extends the length of the threshold 100 within the cavity 150. The upper wall 110 of the threshold 100 presents an annular recess 170

(FIG. 4) in the body portion 160 extending longitudinally along the length of the upper wall 110 for receiving a door seal 200 as to be further described below. When the door 20 is in an open position, a resilient sheet 180 of impervious material tightly extends across the upper surface 110 and recess 170. The sheet 180 is preferably constructed of an elastic neoprene material. Slots 184 are presented at the junctures between the upper surface 110 of the threshold 100 and sides 162 of the body portion 160. Bulbous edges 182 of the sheet 180 can be inserted through the slots 184 into the cavity 150 for releasably coupling the sheet 180 to the threshold 100. Thus, the sheet 180 can be removed and replaced if the sheet's elasticity becomes undesirably stretched out through repeated use as described below.

The threshold 100 is fixedly mounted to a floor surface 40 and extends longitudinally between side walls 30 of the door frame. The threshold 100 is positioned such that the lower edge 50 of the overhead door 20 is aligned with the recess 170. The lower surface 120 of the threshold 100 presents a pair of laterally spaced apart apertures 190 through the lower surface 120 which communicate with slots 192 extending within the body portion 160, the slots having a diameter greater than the apertures 190. Thus, the threshold 100 can be fixedly secured to the floor 40 by aligning the apertures 190 with fasteners 194 such as anchor bolts that are fixedly mounted to the floor surface 40, and then pressing the threshold 100 downward upon the fasteners 194 to snappably couple the threshold 100 thereto. It is understood that the apertures 190 present a diameter that is smaller than the diameter of the fasteners such that the fasteners 194 must be forced therethrough and securely coupled within the slots 192.

The threshold 100 further includes an adhesive layer 122 fixedly attached to the lower surface 120 (FIGS. 3 and 4). The adhesive layer 122 can be covered by plastic or wax paper until the threshold 100 is ready to be installed, at which time the paper can be removed to reveal the adhesive surface. The adhesive layer 122 enhances the secure mounting of the threshold 100 to the floor surface 40 for preventing movement of the door 20 as well as preventing seepage of water beneath the threshold 100.

As shown in FIGS. 3 and 4, the sealing assembly 10 further includes a generally U-shaped sealing member 200 having opposed flanges 210 for fixedly attaching the sealing member 200 to the sides 60 of the door 20 adjacent the lower edge 50 thereof. Tapered shoulders 220 are integrally attached to the lower ends of the flanges 210. The sealing member 200 further includes a preferably non-resilient annular sealing web 230 attached to the shoulders 220 and extending therebetween. Web 230 is complementary in configuration to recess 170.

In operation, the threshold 100 is securely mounted to the floor 40 by first inserting fasteners 194, such as anchor bolts, into the concrete floor and then aligning the slots 192 with the fasteners 194 and snappably coupling them together. The adhesive layer 122 further secures the threshold 100 to the floor surface 40 to prevent movement thereof and to seal the space between the threshold 100 and floor surface 40 against draught. The threshold 100 is mounted at a position between walls 30 of the door frame such that the seal 200 nests with the recess 170 when the door 20 is moved to a closed position.

As the overhead door 20 is moved toward a closed position, the non-resilient sealing web 230 first contacts the resilient sheet 180 which spans the recess 170 in the body portion 160. As the seal 200 nests tightly within the recess 170, the sheet 180 stretches about the sealing web 230 to form an air and moisture barrier between the web 230 and body portion 160. This barrier is enhanced by the complementary configurations of the sealing web 230 and recess 170. Shoulders 220 horizontally contact the sheet at 221 at the opposed portions of the sheet 180 adjacent the recess 170. press the sheet 180 tightly against the upper surface 110 to enhance the integrity of the seal.

The inclined sides 130, 140 of the threshold 100 provide a dam against rising or flowing water. As water rises toward or flows past the overhead door 20, it is repelled by the inclined exterior side wall 140 of the threshold 100.

Figure 5:
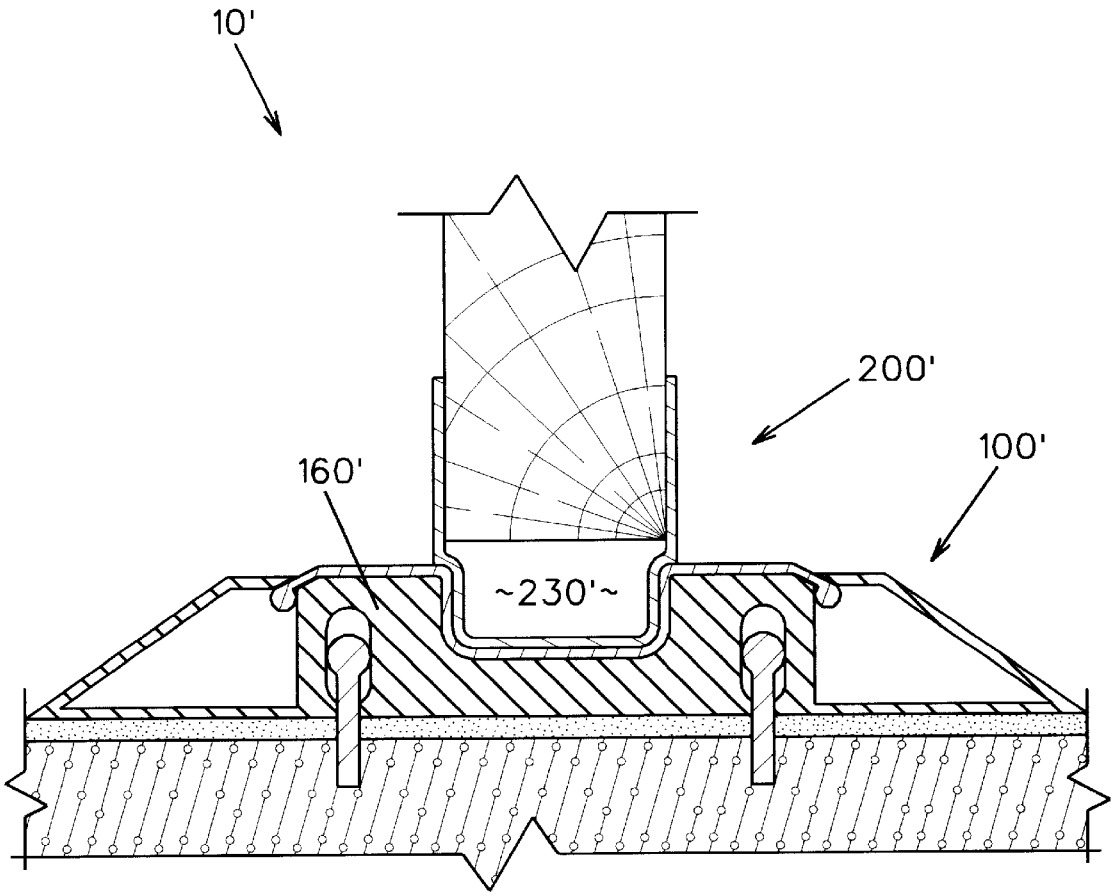
FIG. 5 is a view as in FIG. 3 of a first alternative embodiment of the overhead door sealing assembly.
Figure 6:
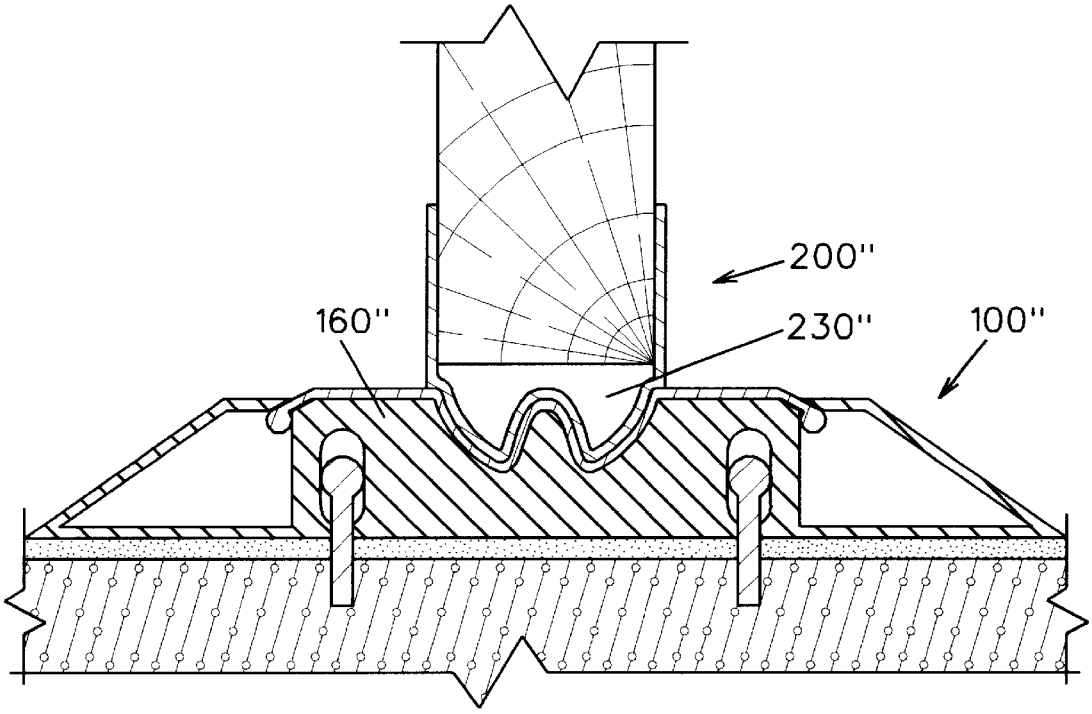
FIG. 6 is a view as in FIG. 3 of a second alternative embodiment of the overhead door sealing assembly.
Figure 7:
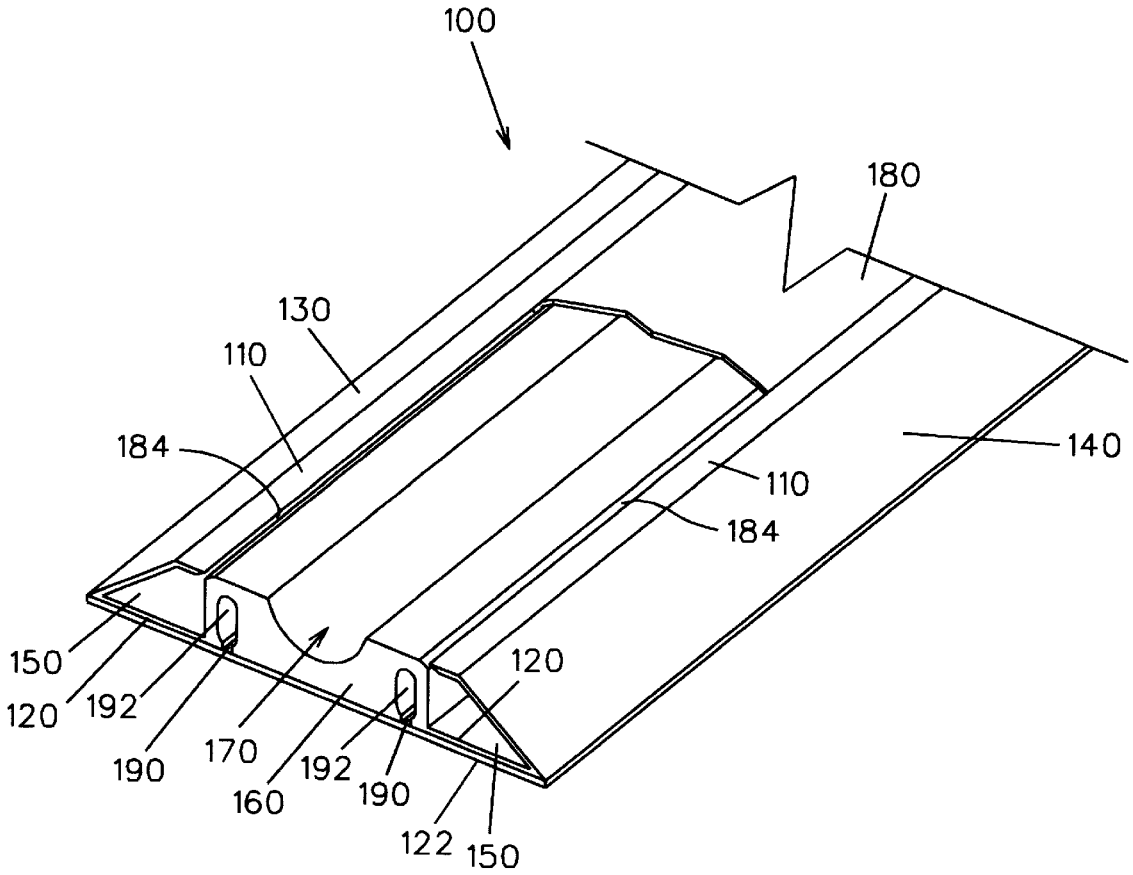
FIG. 7 is a perspective view of the threshold with a portion of the seal removed to show the underlying recess.
Figure 8:
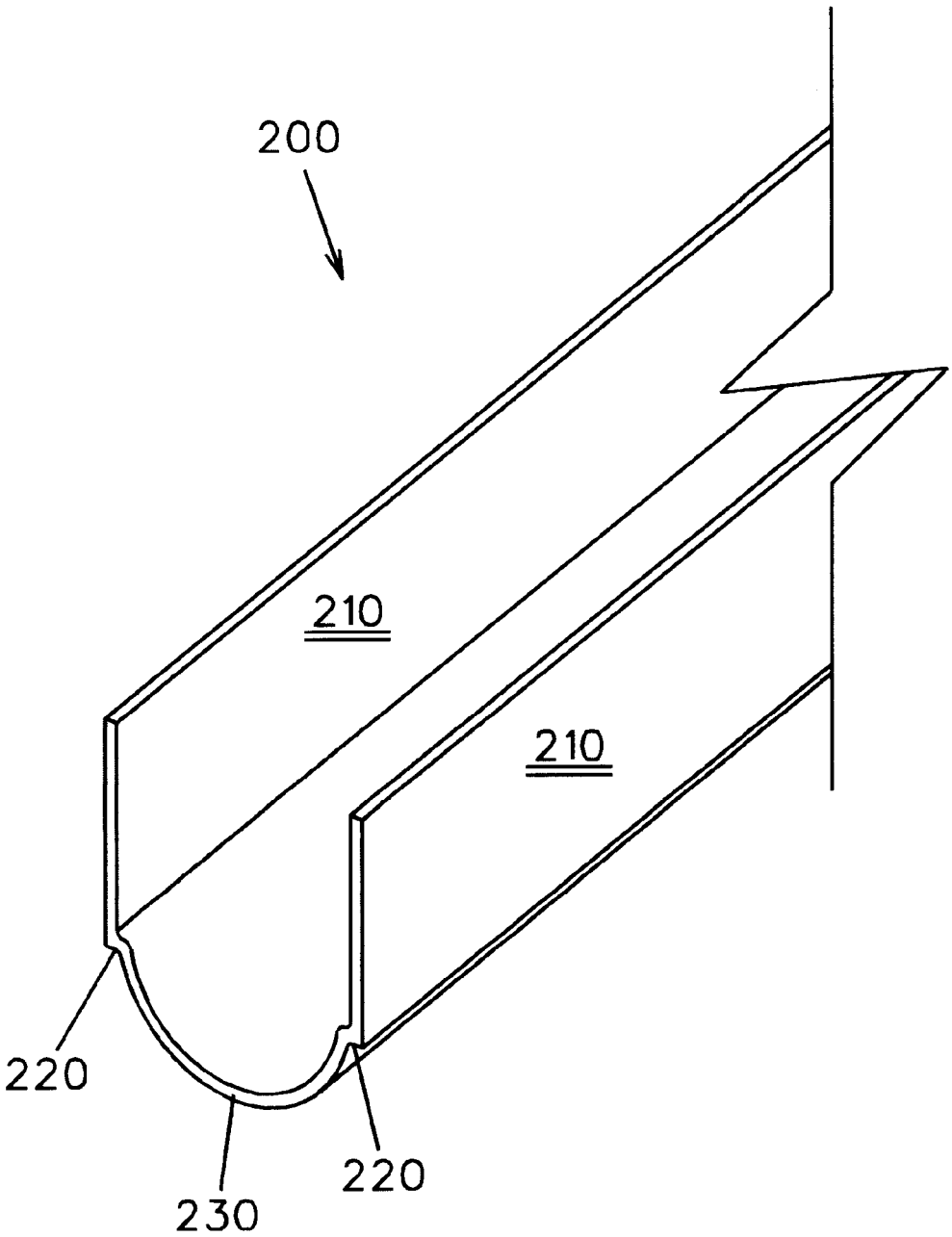
FIG. 8 is a perspective view of the door seal removed from the door.

As shown in FIGS. 5 and 6, alternative embodiments 10', 10" of the sealing assembly are identical in construction to the assembly 10 described above except as noted below, primed numbers being used to reference previously described elements. The recess in the body portions 160', 160" have either a rectangular or W-shaped configuration, respectively. The vertical sidewalls of the FIG. 5 recess or the W-shaped configuration of the FIG. 6 recess enhance the restriction of weather elements between the door 20 and threshold 100', 100". It is understood that the sealing webs 230', 230" of the seals 200', 200" of the alternative assemblies 10', 10" correspond to the respective recess configurations.

It understood that my device may be modified so as to work with a swinging door. For example, web 230 may be relatively resilient so as to allow for web movement across the sheet 180 and surface 110 for nesting within recess. This action allows for door closure. Likewise the resiliency of the web 230 will allow for the nested web to be removed from recess 170 allowing for door opening.

It is understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A door sealing assembly, comprising:

an elongated threshold presenting an upper surface and a lower surface;

means for mounting said threshold to a floor surface;

a recess extending along a length of said upper surface;

a door adapted for vertical movement between an open position displaced from said threshold and a closed position in vertical engagement with said threshold;

a seal attached to a lower edge of said door, said seal configured to nest within said recess upon movement of said door to said closed position; and a resilient sheet extending across said recess upon the door being in said open position to inhibit entry of elements into said recess, said sheet being depressed into said recess by said seal nesting in said recess upon movement of said door to said closed position, whereby said sealing assembly is adapted to close a gap between the lower edge of said door and the floor surface.

2. The door sealing assembly as claimed in claim 1 wherein the door is an overhead door.

3. The door sealing assembly as claimed in claim 1 further comprising:

at least one fastener having a first end adapted for mounting said threshold to the underlying floor surface and a second end.

4. A door sealing assembly as claimed in claim 3 further comprising an aperture in said threshold lower surface presenting a configuration relative to said fastener second end, said aperture adapted to snappably couple said fastener therein.

5. A door sealing assembly as claimed in claim 1 wherein said threshold further comprises oppositely disposed first and second inclined sides extending between said lower and said upper surfaces and extending along the length of said upper and lower surfaces for repelling elements away from said upper threshold surface.

6. A door sealing assembly as claimed in claim 1 wherein said resilient sheet includes first and second longitudinal edges adapted to be releasably coupled to said threshold.

7. A door sealing assembly as claimed in claim 1 wherein said seal and recess comprise complementary configurations whereby said nested seal generally fills said recess with said sheet therebetween at said closed position.

8. A door sealing assembly as claimed in claim 7 wherein said seal and recess comprise complementary arcuate configurations.

9. A door sealing assembly as claimed in claim 7 wherein said seal and recess comprise complementary rectangular configurations.

10. A door sealing assembly as claimed in claim 7 wherein said seal and recess comprise generally complementary W-shaped configurations.

11. A door sealing assembly as claimed in claim 1 wherein said seal includes a pair of opposed shoulders configured to bear against opposed portions of said sheet adjacent said recess, whereby to enhance closure of the gap upon said movement of the door to a closed position.

12. A door sealing assembly, comprising:

an elongated threshold presenting an upper surface and a lower surface;

means for mounting said threshold to a floor surface;

a recess extending along a length of said upper surface;

a door adapted for vertical movement between an open position displaced from said threshold and a closed position in vertical engagement with said threshold;

a non-resilient seal adapted for attachment to a lower edge of said door, said seal configured to nest within said recess upon movement of said door to said closed position; and a resilient cover extending across said recess upon said door being in said open position to inhibit entry of elements into said recess, said cover being depressed into said recess by said seal nesting in said recess upon movement of said door to said closed position, whereby said sealing assembly is adapted to close a gap between the lower edge of said door and the floor surface.

13. The door sealing assembly as claimed in claim 12 wherein said mounting means comprises an adhesive on said lower surface of said threshold, said adhesive generally covering said threshold lower surface to inhibit draught between the underlying floor surface and said lower surface of said threshold.

14. The door sealing assembly as claimed in claim 12 further comprising:

a plurality of fasteners, each fastener having a first end adapted for mounting to the floor surface and a second end;

a plurality of apertures in said threshold lower surface for extension of said fasteners therethrough; and a plurality of slots in said threshold, each of said slots being in communication with one of said apertures, each said slot receiving said second end of one of said fasteners therein upon extension of said second end through said corresponding aperture, said second end in said slot coupling said threshold to said fasteners.

15. A door sealing assembly as claimed in claim 14 wherein each of said apertures presents an opening that is smaller than a cross section of said slot, whereby said fastener second end is retained in each slot upon extension of said fastener second end through said aperture and into said slot.

16. A door sealing assembly as claimed in claim 12 wherein said threshold upper surface presents a pair of laterally spaced apart apertures; and said cover includes first and second longitudinal edges adapted to be inserted through said apertures in said threshold upper surface for releasably coupling said cover to said threshold.

17. A door sealing assembly as claimed in claim 12 wherein said recess and said seal have complementary configurations.

18. A door sealing assembly as claimed in claim 12 wherein said threshold further comprises a pair of inclined sides longitudinally extending along the length of said threshold between said upper and lower surfaces for repelling elements away from said recess.

19. A door sealing assembly, comprising:

an elongated threshold presenting an upper surface and a lower surface;

means for mounting said threshold to a floor surface;

a recess extending along a length of said upper surface;

a door adapted for vertical movement between an open position displaced from said threshold and a closed position in vertical engagement with said threshold;

a seal adapted for attachment to a lower edge of said door, said seal configured to nest within said recess upon movement of said door to said closed position;

a resilient sheet extending across said recess upon said door being in said open position to inhibit entry of elements into said recess, said sheet being depressed into said recess by said seal nesting in said recess upon movement of said door to said closed position, whereby said sealing assembly is adapted to close a gap between the lower edge of said door and the floor surface; and means for releasably mounting said sheet to said threshold.

20. The door sealing assembly as claimed in claim 19 wherein said mounting means comprises:

first and second opposed slots in said upper surface of said threshold and along opposed sides of said recess, said slots releasably engaging opposed edges of said sheet therein.

* * * * *